US006948834B2

(12) United States Patent
Lilly

(10) Patent No.: US 6,948,834 B2
(45) Date of Patent: Sep. 27, 2005

(54) TROLLING MOTOR ASSEMBLY WITH LIGHTING SYSTEM

(76) Inventor: Andrew S Lilly, P.O. 20823, Rochester, NY (US) 14601

( * ) Notice: Subject to any disclaimer, the term of this patent is extended or adjusted under 35 U.S.C. 154(b) by 56 days.

(21) Appl. No.: 10/705,997

(22) Filed: Nov. 12, 2003

(65) Prior Publication Data

US 2005/0099819 A1 May 12, 2005

(51) Int. Cl.[7] ..... B60Q 1/00; F21V 1/00

(52) U.S. Cl. ..... 362/477; 440/2; 440/113; 440/900

(58) Field of Search ..... 362/477, 540, 362/276, 802; 114/343; 340/984; 440/2, 113, 900

(56) References Cited

U.S. PATENT DOCUMENTS 3,502,861 A * 3/1970 Evans ..... 362/477
4,884,173 A * 11/1989 Cassidy ..... 362/477
5,613,886 A * 3/1997 Cribbs ..... 440/2
5,980,073 A * 11/1999 Whipple ..... 362/485
6,170,969 B1 * 1/2001 Dumse ..... 362/477
6,174,078 B1 * 1/2001 Ohm et al. ..... 362/477
6,200,009 B1 * 3/2001 Schulte ..... 362/477
6,386,740 B1 * 5/2002 Grissom ..... 362/477
6,474,851 B1 * 11/2002 Baley ..... 362/477
6,644,829 B1 * 11/2003 Tracy et al. ..... 362/220
2004/0257822 A1 * 12/2004 Hopkins ..... 362/477

* cited by examiner

*Primary Examiner*—Stephen Husar
*Assistant Examiner*—Jason Han
(74) *Attorney, Agent, or Firm*—Jaeckle Fleischmann & Mugel, LLP

(57) ABSTRACT

The present invention provides a lighting system for illuminating the interior of a trolling boat wherein the light is attached to or contained within the trolling motor assembly. The invention comprises in one form thereof, a trolling motor assembly having a motor control compartment, a shaft and a motor/propeller assembly. The motor control compartment further comprises a light assembly attached thereto. In a particular embodiment of the invention the light assembly is fixedly attached to the motor control compartment as to provide a lighting means for the interior of the boat. A further embodiment is contemplated wherein the lighting means is contained within the motor compartment and portion of the motor compartment housing is the appropriate material to permit the passage of light through the motor compartment.

8 Claims, 2 Drawing Sheets

TROLLING MOTOR ASSEMBLY WITH LIGHTING SYSTEM

TECHNICAL FIELD

The present invention relates generally to a lighting system for illuminating the interior to a trolling boat; and more particularly, to a lighting system for illuminating the interior of a trolling boat having a light attached to a trolling motor assembly.

BACKGROUND

Trolling is a saltwater and freshwater fishing method wherein a boat is utilized to drag bait through the water in order to attract and catch fish. This method provides anglers with a means for fishing large areas of water in the least amount of time.

Trolling boats typically have a main motor, and at least one low-powered trolling motor mounted at the rear of the boat. The main motor is used to drive the boat from port to the selected fishing area, or from one fishing area to another. When the boat reaches the desired fishing area, the main motor is disengaged, and the trolling motors are used.

Placement and selection of lures is a critical factor for success in trolling. Anglers must select the proper size, color and style of lure for each specific fish he is attempting to attract. In furtherance of this goal it is necessary that anglers be provided with adequate lighting for their selection and placement of lures. One problem that has not been addressed is the absence of an adequate lighting source for trolling boats. Since trolling is often undertaken between dusk and dawn, lighting conditions are difficult, and a convenient source of light would be of great assistance in rigging the lures. Furthermore, adequate lighting will also serve to optimize productivity and safety.

Motor boats having motors with lights attached thereto are known. One such device is the Outboard Motor/Outdrive Safety Light described in U.S. Pat. No. 6,386,740. The device provides a safety light assembly designed for use with an outboard, motor or the out-drive unit of a motor mounted on a boat which is carried on a trailer being towed by a towing vehicle. The safety light assembly is removably secured to a plate on the drive housing of the motor or out-drive unit by means of clamps.

While the above mentioned device serves to improve the visibility of a motor boat being transported by a trailer, it fails to provide a source of light for the interior of a boat.

Similarly, the Boat Trailer Lighting System described in U.S. Pat. No. 5,980,073 discloses a motor with a light attached thereto. More particularly the patent discloses a boat trailer lighting system apparatus, including a boat trailer for transporting a boat having an outboard motor mounted thereto. An electrical light assembly having an electric lamp is rotatably attached to an outboard motor skeg mounting bracket. The electrical light assembly is connected through an electrical conductor to an electrical power source which may be connected into the tail and brake lights of the trailer so that the light is activated along with the trailer lights.

This device also serves to improve the visibility of a motorboat as it is transported by a trailer, however it does not provide a source of light that will illuminate the interior of a boat.

What is needed in the art is a lighting system that provides a source of light for the interior of a boat.

Furthermore, what is needed in the art is a lighting system for a boat that is relatively inexpensive, and does not require manual operation.

SUMMARY OF THE INVENTION

The present invention provides a lighting system for illuminating the interior of a trolling boat wherein a light is either fixedly attached upon, or contained within the trolling motor assembly. The invention comprises in one form thereof, a trolling motor assembly having a motor control compartment, a shaft and a motor/propeller assembly. The motor control compartment further comprises a light assembly attached thereto.

In a particular embodiment of the invention the light assembly is fixedly attached to the motor control compartment as to provide a lighting means for the interior of the boat. A further embodiment is contemplated wherein the lighting means is contained within the motor compartment and portion of the motor compartment housing is the appropriate material to permit the passage of light through the motor compartment.

BRIEF DESCRIPTION OF THE DRAWINGS

The above-mentioned and other features and advantages of this invention, and the manner of attaining them, will become appreciated and be more readily understood by reference to the following detailed description of one embodiment of the invention in conjunction with the accompanying drawings, wherein.

DETAILED DESCRIPTION OF THE DRAWINGS

Figure 1:
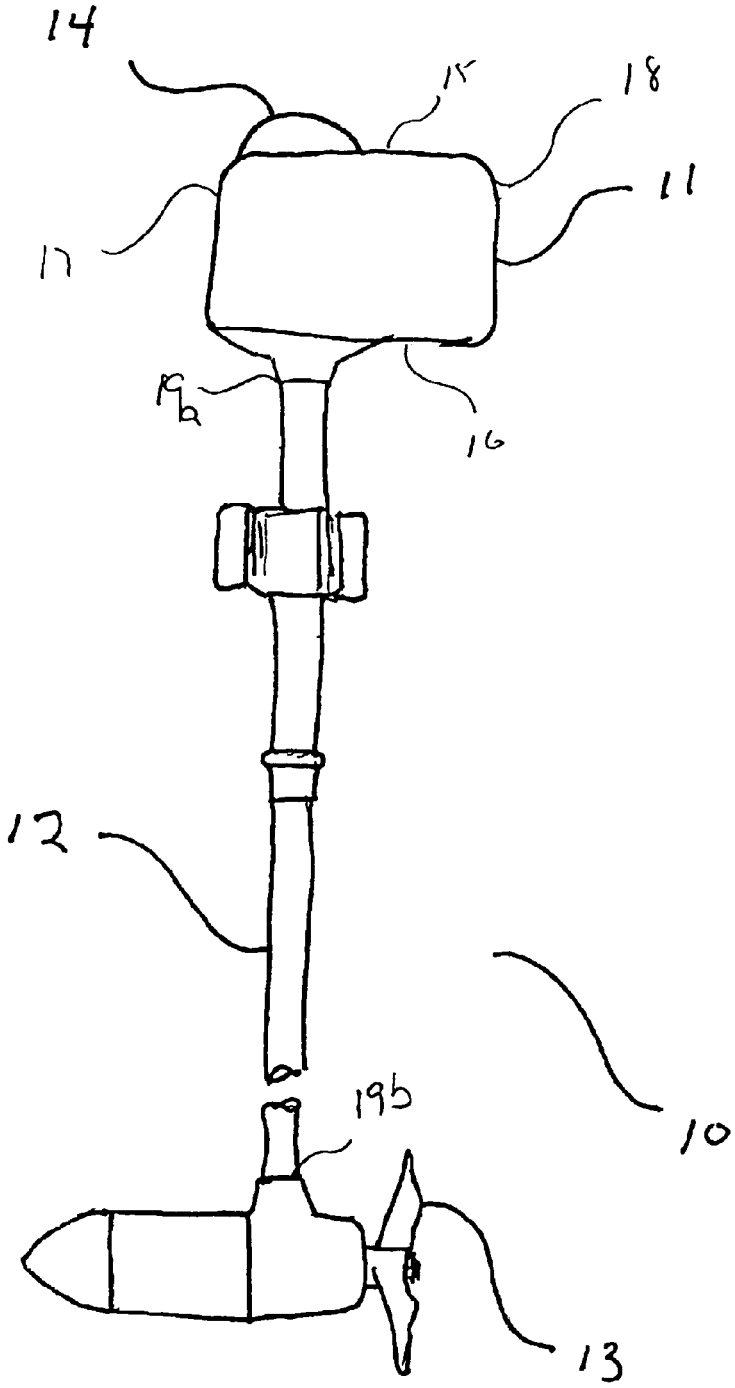
FIG. 1 is a side view of a trolling motor assembly with light mounted upon the motor compartment.

Referring to the drawings, and particularly to FIG. 1, there is shown a particular embodiment of the improved trolling motor assembly 10 of the present invention. The trolling motor assembly 10 comprises, in one form thereof, a motor assembly 10 having a motor control compartment 11. The motor control compartment 11 further comprises a motor control compartment top 15 and a motor control compartment bottom 16. The motor control compartment bottom 16 is in communication with a propeller/drive unit shaft 12 extending downward from said motor control compartment 11. Said propeller/drive unit shaft 12 further comprises a motor control compartment coupling end 19*a* and a propeller/drive unit coupling end 19*b* wherein said propeller/drive unit coupling end 19*b* communicates with a propeller/drive unit 13. The top side of the motor control compartment 11 further comprises a front portion 17 and a back portion 18 wherein said front portion 17 is adjacent to the interior of boat (not shown) and the back portion 18 is facing away from the boat. The motor control compartment 11 further comprises a light assembly 14 attached thereto. The light assembly 14 is attached to the front portion 17 of the motor compartment top 15, and is positioned so as to illuminate the inner section of the boat (not shown).

Figure 2:
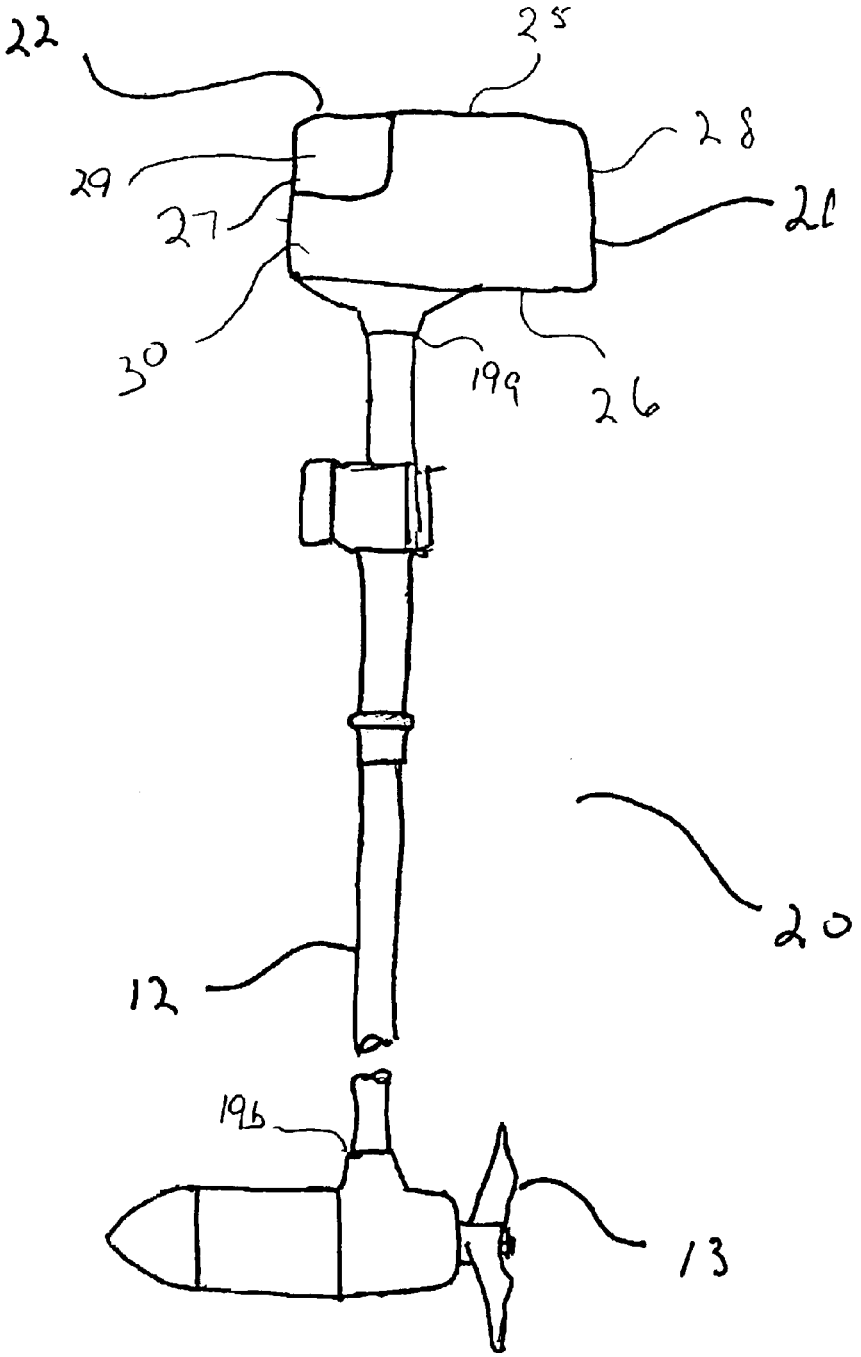
FIG. 2 is a side view of a trolling motor assembly with light integral with the motor control compartment.

Referring now to FIG. 2, an additional embodiment of the present invention is shown. The trolling motor assembly 20 comprises in one form thereof a motor assembly having a motor control compartment 21. The motor control compartment 21 further comprises a motor control compartment top 25 and a motor control compartment bottom 26. The motor control compartment bottom 26 is in communication with a propeller/drive unit shaft 12 extending downward from said motor control compartment 21. Said propeller/drive unit shaft 12 further comprises a motor control compartment coupling end 19*a* and a propeller/drive unit coupling end 19*b* wherein said propeller/drive unit coupling end 19*b* communicates with a propeller/drive unit 13. The top side of the motor control compartment 21 further comprises a front portion 27 and a back portion 28 wherein said front portion 27 is adjacent to the interior of boat (not shown) and the back portion 28 is facing away from the boat. The motor control compartment 21 further comprises a lighting means 22 contained therein. The lighting means 22 is integral with the motor control compartment 21. Furthermore, the housing 30 of motor control compartment 21 shall have a portion that is substantially translucent 29. The substantially translucent portion 29 of the housing 30 is positioned to allow the passage of light from the lighting means 22 to the interior of the boat (not shown). An embodiment is contemplated wherein the substantially translucent portion 29 of the housing 30 shall include a section of the front portion 27 of the motor compartment top 25 so that the lighting means 22 contained within the motor control compartment 21 will illuminate the interior of the boat.

Additionally, embodiments of the above motor compartments are contemplated to have a variety of different power sources for supplying electricity to the lights. One particular embodiment will use a standard DC battery dedicated to provide the electricity necessary to power the light. An additional embodiment is contemplated wherein the lighting means will share the power source with the drive motor.

The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

I claim:

1. A trolling motor assembly that provides illumination for the interior of a trolling boat, said trolling motor assembly comprising:

a motor control compartment comprising a top and a bottom, said top further comprising a front portion adjacent to said interior of said boat, and a back portion disposed away from said boat;

a motor/propeller assembly including a shaft; and a light assembly attached to said motor control compartment, said light assembly being mounted upon said front portion of said top of said motor control compartment.

2. The trolling motor assembly of claim 1 wherein a portion of said front portion of said top of said motor control compartment is substantially translucent, and said light assembly is contained within said motor control compartment;

wherein in said substantially translucent portion of said front portion of said top of said motor control compartment allows the passage of light from said light assembly to said interior of said boat.

3. The trolling motor assembly of claim 1 wherein said light assembly is powered by a dedicated DC power device.

4. The trolling motor assembly of claim 1 wherein said light assembly is powered by the same device as a main drive motor of said boat.

5. A trolling boat comprising a trolling motor assembly that provides illumination for the interior of a trolling boat, said trolling motor assembly including:

a motor control compartment comprising a top and a bottom, said top further comprising a front portion adjacent to said interior of said boat and a back portion disposed away from said boat;

a motor/propeller assembly including a shaft; and a light assembly attached to said motor control compartment, said light assembly being mounted upon said front portion of said top of said motor control compartment.

6. The trolling boat of claim 5 wherein portion of said front portion of said top of said motor control compartment is substantially translucent, and said light assembly is contained within said motor control compartment;

wherein said substantially translucent portion of said front portion of said top of said motor control compartment allows the passages of light from said light assembly to said interior of said boat.

7. The trolling boat of claim 5 wherein said light assembly is powered by a dedicated DC power device.

8. The trolling boat of claim 5 wherein said light assembly is powered by the same device as a main drive motor of said boat.

* * * * *